US012677873B2

(12) United States Patent
Lu et al.

(10) Patent No.: US 12,677,873 B2
(45) Date of Patent: Jul. 14, 2026

(54) ATOMIZER AND ELECTRONIC CIGARETTE

(71) Applicant: SHENZHEN FIRST UNION TECHNOLOGY CO., LTD., Shenzhen City (CN)

(72) Inventors: Linhai Lu, Shenzhen City (CN); Yinzhe Li, Shenzhen City (CN); Zhongli Xu, Shenzhen City (CN); Yonghai Li, Shenzhen City (CN)

(73) Assignee: SHENZHEN FIRST UNION TECHNOLOGY CO., LTD., Shenzhen City (CN)

( * ) Notice: Subject to any disclaimer, the term of this patent is extended or adjusted under 35 U.S.C. 154(b) by 367 days.

(21) Appl. No.: 17/918,113

(22) PCT Filed: Apr. 12, 2021

(86) PCT No.: PCT/CN2021/086418
§ 371 (c)(1),
(2) Date: Oct. 10, 2022

(87) PCT Pub. No.: WO2021/204285
PCT Pub. Date: Oct. 14, 2021

(65) Prior Publication Data

US 2023/0134641 A1 May 4, 2023

(30) Foreign Application Priority Data

Apr. 10, 2020 (CN) ..... 202010281282.2

(51) Int. Cl.
*A24F 40/10* (2020.01)
*A24F 40/40* (2020.01)
(Continued)

(52) U.S. Cl.
CPC ..... *A24F 40/10* (2020.01); *A24F 40/42* (2020.01); *A24F 40/44* (2020.01); *A24F 40/485* (2020.01)

(58) Field of Classification Search
None
See application file for complete search history.

(56) References Cited

U.S. PATENT DOCUMENTS

2011/0192914 A1* 8/2011 Ishigami ..... A61M 15/0085 239/102.2
2018/0015385 A1* 1/2018 Meinhart ..... H05B 3/02
(Continued)

FOREIGN PATENT DOCUMENTS

CN 206079029 U 4/2017
CN 207444273 U 6/2018
(Continued)

*Primary Examiner* — Philip Y Louie
*Assistant Examiner* — Vu P Pham
(74) *Attorney, Agent, or Firm* — Scully, Scott, Murphy & Presser, P.C.

(57) ABSTRACT

An atomizer of an electronic cigarette includes an outer housing, and the outer housing is internally provided with a liquid storage cavity and an atomization assembly; the atomization assembly includes a first side wall and a second side wall opposite to each other, and an atomization surface extending from the first side wall to the second side wall; a holder is provided within the outer housing, and the holder is provided with a first surface opposite to the atomization surface along the axial direction of the outer housing; and an atomization cavity is formed between the first surface and the atomization surface; and the first surface is configured to be inclined towards the atomization surface along the extension direction of the atomization surface, and is configured to receive a liquid substrate seeped from the atomization assembly and/or condensate formed by condensation of the aerosol within the atomization cavity.

13 Claims, 7 Drawing Sheets

(51) Int. Cl.

| | |
|---|---|
| ***A24F 40/42*** | (2020.01) |
| ***A24F 40/44*** | (2020.01) |
| ***A24F 40/485*** | (2020.01) |

(56) References Cited

U.S. PATENT DOCUMENTS

| | | | | |
|---|---|---|---|---|
| 2019/0223506 | A1* | 7/2019 | Biel | A24F 15/015 |
| 2019/0335809 | A1* | 11/2019 | Han | H05B 3/46 |
| 2022/0218038 | A1* | 7/2022 | Lei | A24F 40/485 |

FOREIGN PATENT DOCUMENTS

| | | | |
|---|---|---|---|
| CN | 208048026 | U | 11/2018 |
| CN | 110279158 | A | 9/2019 |
| CN | 110638101 | A | 1/2020 |
| CN | 210203317 | U | 3/2020 |
| EP | 3292775 | A1 | 3/2018 |
| EP | 3799742 | A1 | 4/2021 |
| WO | 2020/039178 | A1 | 2/2020 |

* cited by examiner

ATOMIZER AND ELECTRONIC CIGARETTE

CROSS-REFERENCE TO RELATED APPLICATIONS

The present application is a 35 U.S.C. § 371 National Phase conversion of International (PCT) Patent Application No. PCT/CN2021/086418, filed on Apr. 12, 2021, which claims priority to the Chinese Patent Application No. 202010281282.2, filed on Apr. 10, 2020 and entitled "ATOMIZER AND ELECTRONIC CIGARETTE", which is incorporated herein by reference in its entirety. The PCT International Patent Application was filed and published in Chinese.

TECHNICAL FIELD

Embodiments of the present application relate to the technical field of electronic cigarettes, and in particular relate to an atomizer and an electronic cigarette.

BACKGROUND

An electronic cigarette is a product for heating and atomizing a liquid substrate containing nicotine to generate an aerosol to be smoked by a user. The portion, achieving an atomization function, of the electronic cigarette is an atomizer, and the atomizer structurally includes a liquid storage cavity for storing the liquid substrate, a porous body for absorbing the liquid substrate from the liquid storage cavity, and a heating body for heating and atomizing the liquid substrate absorbed by the porous body. Furthermore, in order to transmit the aerosol in a smoking process, an air inlet for allowing air to enter and a smoke transmission pipe for outputting the aerosol are provided at the portion, corresponding to the heating body, of a housing of the atomizer. In the smoking process of the user, external air enters the atomizer from the air inlet and then carries the aerosol to be output through the smoke transmission pipe, to form a complete airflow circulation.

Due to the configuration of an airflow circulation structure, the liquid substrate seeped from the porous body in a use process of the atomizer and condensate formed after the aerosol formed by heating is cooled in a transmission process can flow out of the air inlet after being accumulated in the atomizer, thereby causing oil seepage and pollution.

Based on the above content, an improved US201820119392.7 in the prior art provides an atomizer with an air inlet shielding structure, which employs a blocking plate which can be projected onto an axial plane of the atomizer to cover the air inlet, thereby shielding the air inlet, and preventing the liquid substrate from flowing out. After the blocking plate structure is added, on one hand, smoking resistance is increased; and on the other hand, an external airflow entering from the air inlet becomes diffused. Thus, a part of the generated aerosol is diffused to edge corners to be retained, and the smoke output efficiency is reduced.

SUMMARY

In order to solve the problem of seepage of a liquid substrate of an electronic cigarette in the prior art, embodiments of the present application provide an atomizer that can avoid seepage of the liquid substrate and improve the aerosol output efficiency.

An embodiment of the present application provides an atomizer, including an outer housing, the outer housing being internally provided with a liquid storage cavity for storing a liquid substrate, and an atomization assembly for atomizing the liquid substrate to generate an aerosol, and the atomization assembly including a first side wall and a second side wall opposite to each other, and an atomization surface extending from the first side wall to the second side wall; where a holder is provided within the outer housing, and the holder is provided with a first surface opposite to the atomization surface along the axial direction of the outer housing; and an atomization cavity is formed between the first surface and the atomization surface.

The first surface is configured to be inclined towards the atomization surface along the extension direction of the atomization surface, and is configured to receive the liquid substrate seeped from the atomization assembly and/or condensate formed by condensation of the aerosol within the atomization cavity.

In a preferred embodiment, an air inlet for allowing external air to enter and an airflow channel for outputting the aerosol are further provided within the outer housing. The outer housing is provided with a first communication port close to the first side wall, and the outer housing is provided with a second communication port in communication with the atomization cavity close to the second side wall, such that an airflow entering the atomization cavity from the air inlet at least partially flows to the airflow channel along the extension direction of the atomization surface under the guidance of the first surface, and the atomization cavity is in airflow communication with the air inlet through the first communication port, and is in airflow communication with the airflow channel through the second communication port.

In a preferred embodiment, the first communication port is opposite to at least a part of the first surface along the extension direction of the atomization surface.

In a preferred embodiment, the holder further includes a second surface with the back facing the first surface along the axial direction of the outer housing, the second surface being configured to absorb or retain the liquid substrate and/or condensate received by the first surface.

In a preferred embodiment, the holder is configured to further include a drainage side wall, and guide the liquid substrate and/or condensate received by the first surface to the second surface through the drainage side wall.

In a preferred embodiment, the second surface is provided with grooves that absorb or retain the liquid substrate and/or condensate by capillary action.

In a preferred embodiment, the holder includes a housing, and a liquid absorption component accommodated in the housing and capable of absorbing the liquid substrate and/or condensate by capillary action; where, the first surface is formed on the housing; and at least a part of the liquid absorption component is exposed out of the housing and forms the second surface.

In a preferred embodiment, a projection of at least a part of the first surface on a plane perpendicular to the axial direction of the outer housing covers the atomization surface.

In a preferred embodiment, the outer housing is configured as a hollow cylinder having an open end;

an end cover is provided at the open end, and the air inlet is formed in the end cover; and a sealing mechanism for sealing the liquid storage cavity and accommodating and retaining the atomization assembly is further provided within the outer housing; and at least a part of the airflow channel is provided on the sealing mechanism.

The present application further provides an electronic cigarette, including a power supply apparatus and the atomizer as described above, the power supply apparatus is configured to supply power to the atomizer, and the atomizer is an atomization apparatus configured to atomize the liquid substrate to generate an aerosol for smoking.

With the use of the above atomizer, the inclined first surface on the holder is used for receiving the seeped liquid substrate and condensate, and guiding the airflow within the atomization cavity, which reduces liquid seepage, and guides and improves output of the aerosol.

BRIEF DESCRIPTION OF DRAWINGS

One or more embodiments are illustrated by pictures in the corresponding accompanying drawings, which are not intended to limit the embodiments, in which elements having the same reference numerals represent similar elements, and the figures of the accompanying drawings are not intended to constitute a scale limitation unless specifically stated otherwise.

and

Figure 9:
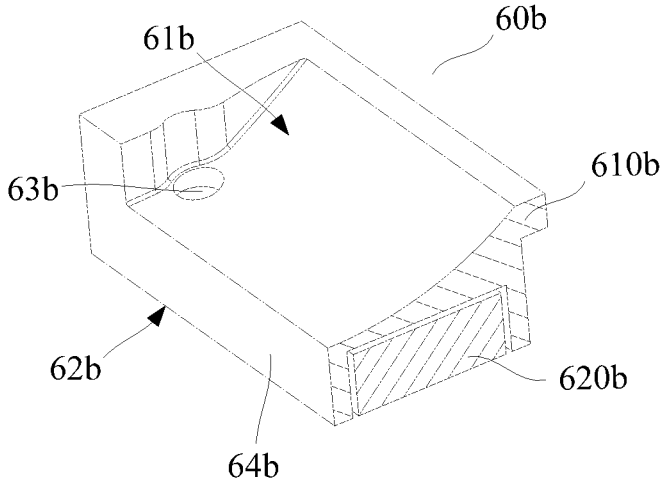

FIG. 9 is a schematic diagram of a cross section of a holder according to another embodiment.

DETAILED DESCRIPTION

To facilitate the understanding of the present application, the present application will be described in more detail below with reference to the accompanying drawings and specific embodiments.

Figure 1:
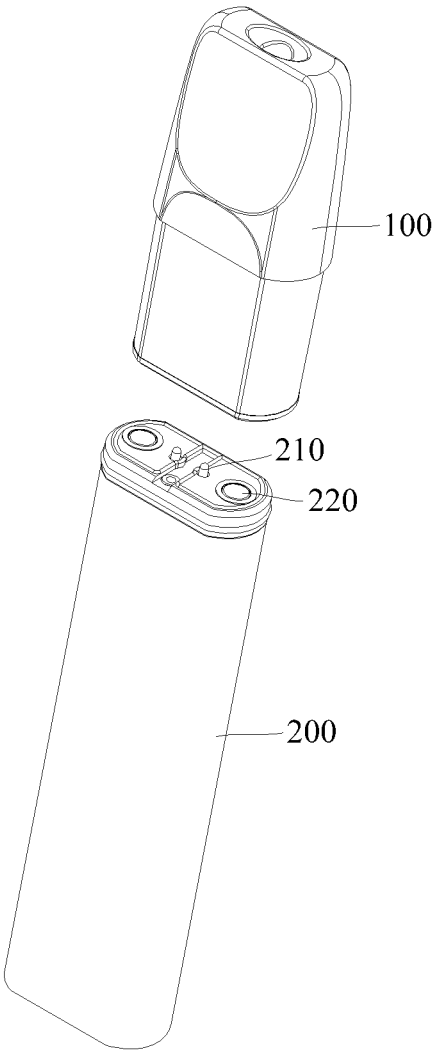
FIG. 1 is a schematic diagram of an electronic cigarette according to an embodiment.
Figure 2:
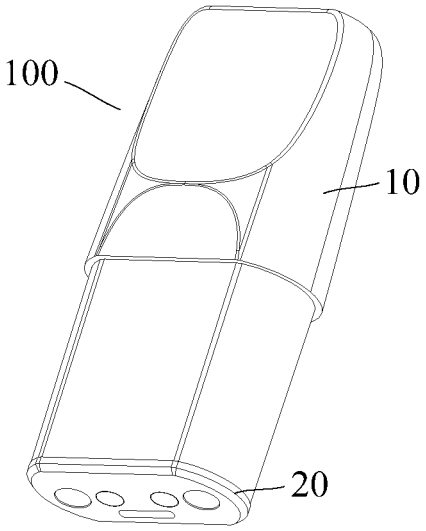
FIG. 2 is a schematic structural diagram of an atomizer in FIG. 1 in another perspective.

Embodiments of the present application provides an electronic cigarette product for heating and atomizing a liquid substrate. In an embodiment, a common flat cigarette shown in FIG. 1 and FIG. 2 is used as an example for illustration, including an atomizer 100 for atomizing a liquid substrate, and a power supply apparatus 200 for supplying power to the atomizer 100. The power supply apparatus 200 is further provided with conductive elastic pins 210 which are configured to be correspondingly connected to the atomizer 100 for electric conduction; and a magnet 220 that is correspondingly magnetically attracted to a magnetic attraction element on the atomizer 100.

Figure 3:
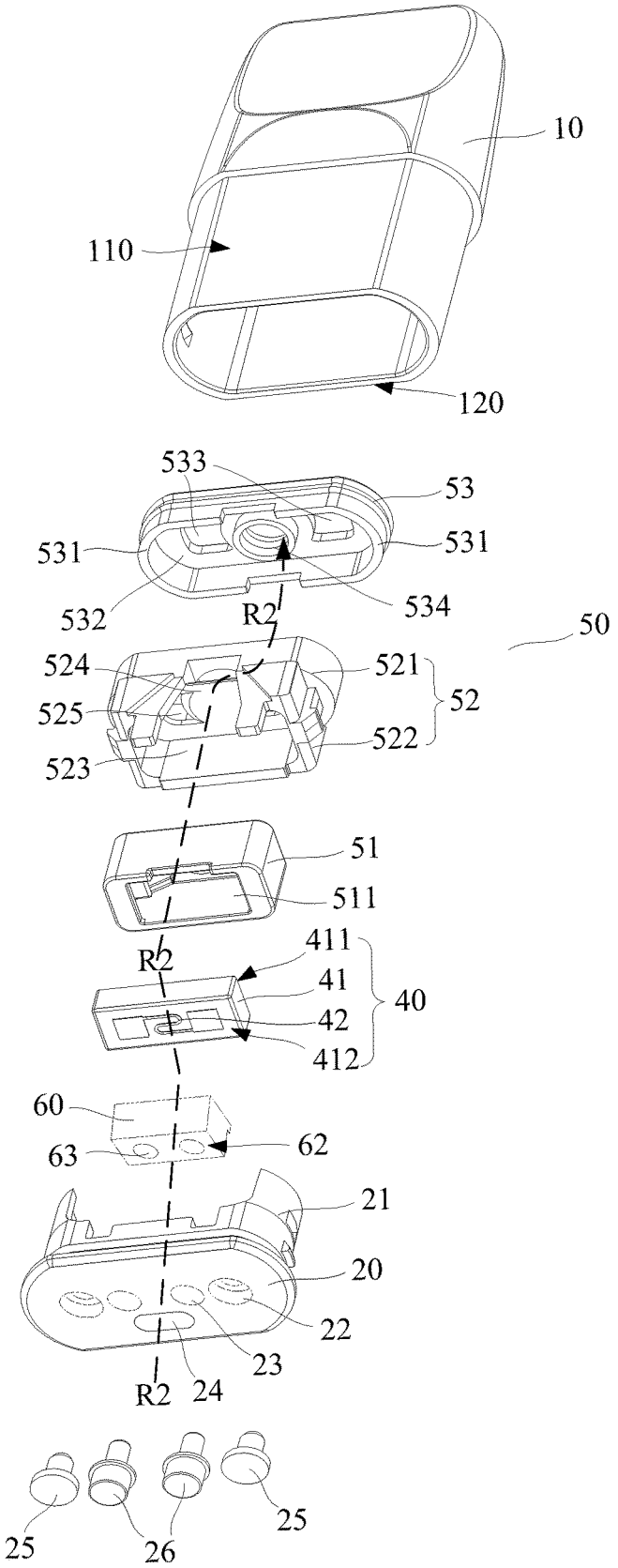
FIG. 3 is an exploded schematic diagram of components of the atomizer shown in FIG. 2 before assembly.
Figure 4:
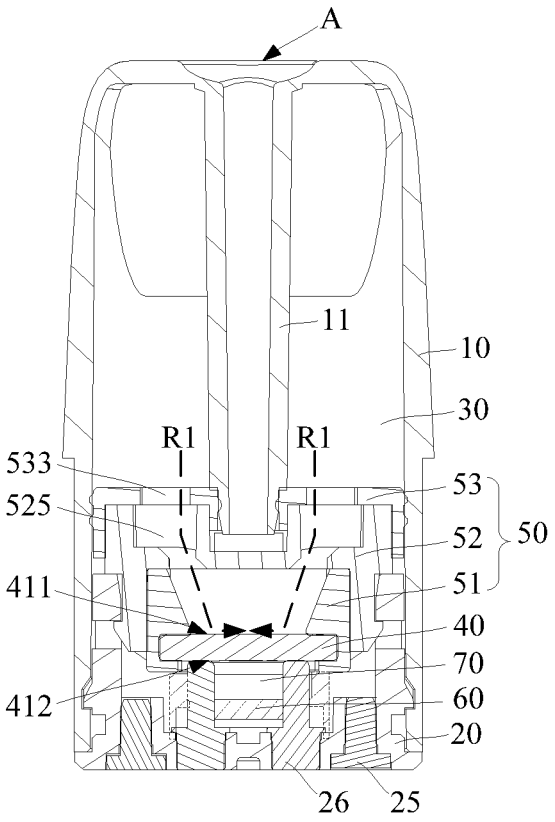
FIG. 4 is a schematic diagram of a cross section of the atomizer shown in FIG. 2 along the width direction.

The detailed structure of the atomizer 100 can refer to the exploded schematic diagram of FIG. 3 and the cross-sectional schematic diagram of FIG. 4, including:

a hollow cylindrical outer housing 10, the outer housing 10 having a proximal end and a distal end opposite to each other along the axial direction; where according to the requirements of common use, the proximal end is configured to be the end at which a user smokes an aerosol, and the distal end is configured to be the end to which the power supply apparatus 200 is assembled and connected; for ease of description, the outer housing 10 further has a first side wall 110 and a second side wall 120 opposite to each other along the thickness direction.

Based on the above differences of use, a smoking port A is provided at the proximal end of the outer housing 10, for the user to conduct a smoking operation; the distal end of the outer housing 10 is designed to be open and a detachable end cover 20 is installed thereon, and the open structure of the distal end of the outer housing is configured to install all necessary functional parts into the outer housing 10.

In some embodiments, the outer housing is provided with a first communication port 71 next to the first side wall, and the first communication port 71 is convenient for outside air to enter the interior of the atomizer.

In some embodiments, the outer housing is provided with a second communication port 72 next to the second side wall, and the second communication port 72 is convenient for air inside the atomizer to flow out of the atomizer.

Furthermore, the outer housing 10 is internally provided with a liquid storage cavity 30 for storing the liquid substrate and an atomization assembly 40 for absorbing the liquid substrate from the liquid storage cavity 30 and heating and atomizing the same. Specifically, in the cross-sectional schematic structural diagram shown in FIG. 4, a smoke transmission pipe 11 provided along the axial direction is provided within the outer housing 10. A space between an outer wall of the smoke transmission pipe 11 and an inner wall of the outer housing 10 forms a liquid storage cavity 30 for storing the liquid substrate. A first end, opposite to the proximal end, of the smoke transmission pipe 11 is in communication with the smoking port A, and a second end, opposite to the distal end, of the smoke transmission pipe is connected to the atomization assembly 40, such that the aerosol generated by the atomization assembly 40 atomizing the liquid substrate is transmitted to the smoking port A for smoking.

Referring to the structure of the atomization assembly 40 shown in FIG. 3, the atomization assembly may include a porous body 41 for absorbing the liquid substrate from the liquid storage cavity 30, and a heating element 42 for heating and atomizing the liquid substrate absorbed from the porous body 41. As shown in FIG. 3, the porous body 41 may be substantially of, but not limited to, a block-shaped structure in the embodiments, including, depending on the situation of use, a liquid absorption surface 411 and an atomization surface 412 opposite to each other along the axial direction of the outer housing 10, that is, an upper surface and a lower surface of the block-shaped porous body 41 in FIG. 3, where the atomization surface 412 is formed by extending from the first side wall 110 to the second side wall 120. In addition, the liquid absorption surface 411 is opposite to the liquid storage cavity 30 and in direct or indirect contact with the liquid substrate within the liquid storage cavity 30 so as to absorb the liquid substrate. Then, a porous structure within the porous body 41 transfers the liquid substrate to the atomization surface 412 to be heated and atomized to form the aerosol, and the aerosol is released from the atomization surface 412. According to the structure of the porous body 41 shown in FIG. 3, because the liquid absorption surface 411 and the atomization surface 412 are parallel to each other, the movement directions of the liquid substrate and the aerosol within the porous body 41 are perpendicular to the plane of the atomization surface 412. The aerosol and liquid substrate will move more smoothly within the porous body 41 and be more convenient to manufacture.

In some embodiments, the porous body 41 may be made of a porous ceramic, porous glass ceramic, porous glass or another hard capillary structure. The heating element 42 is preferably formed on the atomization surface 412 by means of mixing conductive raw material powder with a printing aid to form paste and then sintering after printing, such that all or most of the surface of the heating element is tightly combined with the atomization surface 412, and the effects of being high in atomization efficiency, less in heat loss, capable of preventing dry burning or greatly reducing dry burning and the like are achieved. The heating element 42 may be made of stainless steel, nickel-chromium alloy, iron-chromium-aluminum alloy, metallic titanium, or the like in some embodiments.

Furthermore, referring to FIG. 2 to FIG. 4, in order to facilitate installation and fixation of the atomization assembly 40 and to seal the liquid storage cavity 30, a sealing mechanism 50 is further provided within the outer housing 10, and the sealing mechanism 50 includes a silica gel sleeve 51, a rigid support sleeve 52, and a silica gel seat 53, which seal the port of the liquid storage cavity 30 and also retain and fix the atomization assembly 40 inside, The structure and shape of the silica gel sleeve 51 are not limited. In some embodiments, the silica gel sleeve 51 is substantially annular, and an interior hollow 511 of the silica gel sleeve is configured to accommodate the atomization assembly 40 and be sleeved outside the atomization assembly 40 in a flexible fitting manner.

The support sleeve 52 supports and protects the atomization assembly 40 sleeved with the silica gel sleeve 51. In some embodiments, the support sleeve 52 may include a substantially cylindrical main body portion 521 and a clamping wall 522 extending downwardly from a bottom surface of the main body portion 521. The clamping wall 522 is C-shaped, thereby forming a retaining cavity 523 within the clamping wall 522 for accommodating and retaining the silica gel sleeve 51 and the atomization assembly 40. The support sleeve 52 is provided with an airflow channel 524 on the side opposite to the first side wall 110 of the outer housing 10, for outputting the aerosol generated by the atomization surface 412. First liquid guide holes 525 are formed in the support sleeve 52 for transferring the liquid substrate to the liquid absorption surface 411.

In some embodiments, at least a part of the airflow channel 524 is provided on the sealing mechanism.

The silica gel seat 53 is provided at the end, facing the distal end, of the liquid storage cavity 30, and the shape of the silica gel seat is matched with a cross section of an inner contour of the outer housing 10, so as to seal the liquid storage cavity 30, and prevent the liquid substrate from being seeped out of the liquid storage cavity 30. Furthermore, in order to prevent the tightness of sealing from being affected by shrinkage deformation of the silica gel seat 53 made of a flexible material, the above rigid support sleeve 52 is accommodated in the silica gel seat 53 to provide support. In a matched structure, the silica gel seat 53 is provided with two opposite second clamping walls 531 extending downwards from the bottom surface, and an accommodating cavity 532 for accommodating the main body portion 521 of the support sleeve 52 is formed between the two second clamping walls 531. Meanwhile, two second liquid guide holes 533 and an air pipe insertion hole 534 are formed in the silica gel seat 53; where the two second liquid guide holes 533 correspond to the two first liquid guide holes 525 in the support sleeve 52, such that the liquid substrate within the liquid storage cavity 30 can flow to the liquid absorption surface 411 of the porous body 41 to be absorbed after passing through the second liquid guide holes 533 and the first liquid guide holes 525. The air pipe insertion hole 534 is configured to allow the lower end of the smoke transmission pipe 11 to be inserted in, and meanwhile, after installation, the smoke transmission pipe 11 is in airflow communication with the airflow channel 524, to output the generated aerosol to the smoking port A.

Furthermore, in order to stabilize the sealing mechanism 50 within the atomizer 100, the end cover 20 has two first support arms 21 standing on a top surface of a cover body of the end cover 20 for supporting the sealing mechanism 50.

Meanwhile, the end cover 20 is provided with a first mounting hole 22, a second mounting hole 23 and an air inlet 24. A magnetic element 25, such as a magnet or a ferromagnetic element, which can be magnetically attracted to a magnet 220 of the power supply apparatus 200 is installed within the first mounting hole 22, and an electrode post 26 is installed within the second mounting hole 23 and is configured to supply power to the heating element 42 as a power supply electrode after being connected to the conductive elastic pins 210 of the power supply apparatus 200. The air inlet 24 is configured to allow the outside air to enter the atomizer 10 during a smoking process.

When in use, as shown by an arrow R1 in FIG. 4, the liquid substrate enters an annular space of the silica gel sleeve 51 after passing through the second liquid guide holes 533 and the first liquid guide holes 525 from the liquid storage cavity 30, and is absorbed by the liquid absorption surface 411 of the porous body 41, and transferred to the atomization surface 412 to be heated and atomized by the heating element 42, so as to form an aerosol for release.

Furthermore, in order to enable the aerosol to be released and transferred more smoothly, referring to FIG. 3 and FIG. 4, a holder 60 is provided between the end cover 20 and the atomization surface 412. The holder 60 keeps certain spacing from the atomization surface 412 for forming an atomization cavity 70 to release the aerosol.

Figure 7:
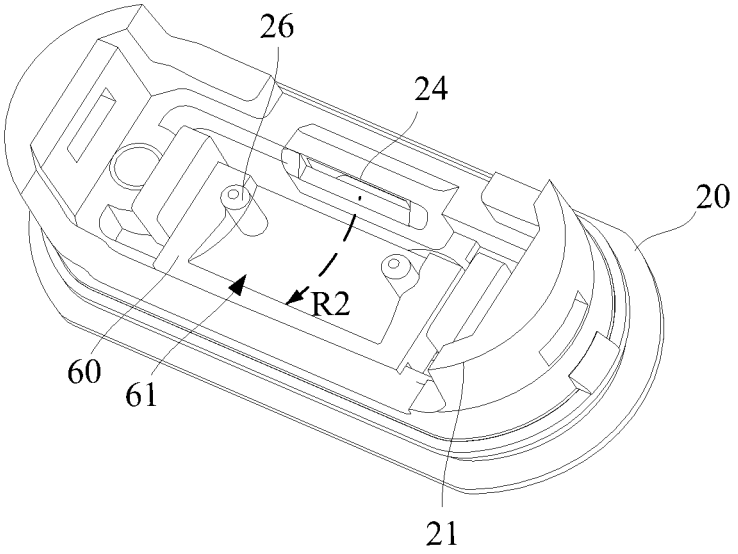
FIG. 7 is a schematic structural diagram after an end cover and the holder in FIG. 3 are assembled.

Furthermore, referring to FIG. 3 and FIG. 7, the air inlet 24 is configured to be positioned close to the second side wall 120 of the outer housing 10 such that the air inlet and the airflow channel 524 are respectively positioned on two sides of the atomization cavity 70. Furthermore, referring to FIG. 3, FIG. 5 and FIG. 7, in the direction of a smoking airflow, the air entering from the air inlet 24 enters the atomization cavity 70 from the position close to the second side wall 120, and then is output to the smoke transmission pipe 11 through the airflow channel 524 close to the first side wall 110 after passing through the atomization cavity 70 along the thickness direction of the outer housing 10. When the user smokes, an airflow can pass through the whole atomization cavity 70, such that the aerosol within the atomization cavity 70 can be guided out along with the airflow to the maximum extent to reduce retention, thereby improving smoke output efficiency, and avoiding generation of the condensate within the atomization cavity 70.

In some embodiments, the air inlet 24 is in communication with the first communication port 71, which is convenient for the outside air to enter the atomization cavity.

In some embodiments, the airflow channel 524 is in communication with the second communication port 72, which is convenient for the air within the atomization cavity 70 to flow out.

Figure 5:
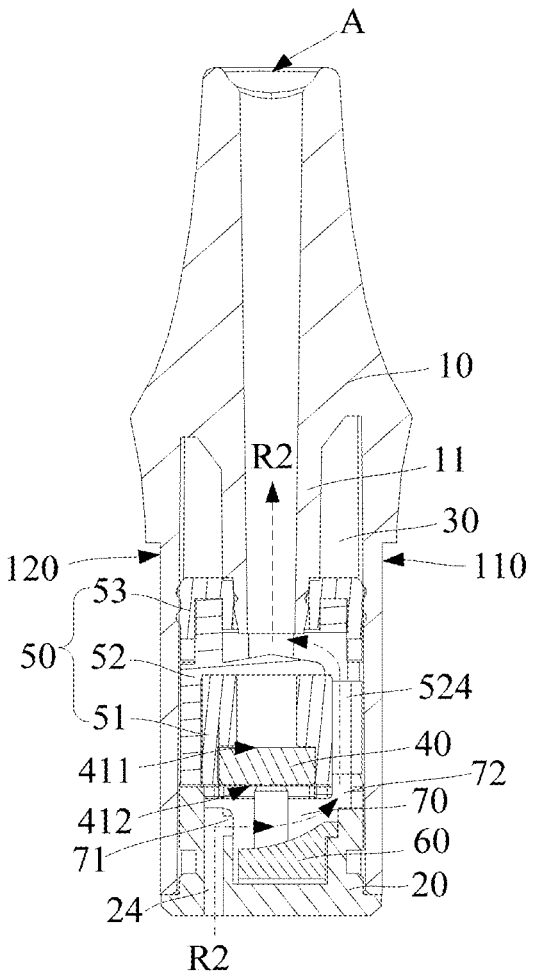
FIG. 5 is a schematic diagram of a cross section of the atomizer shown in FIG. 2 along the thickness direction.
Figure 6:
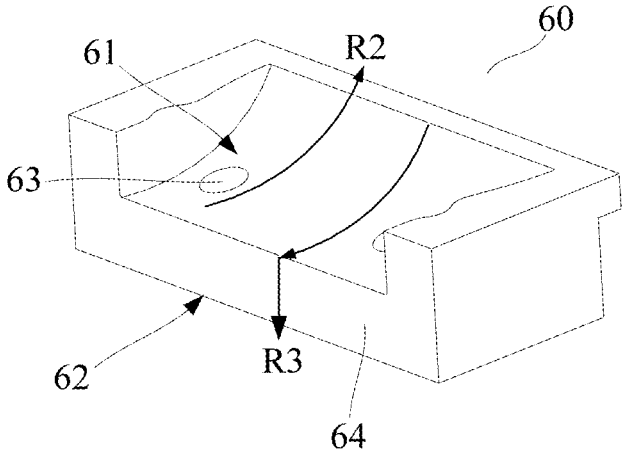
FIG. 6 is a schematic structural diagram of a holder in FIG. 3 in another perspective.

Furthermore, referring to FIG. 5, FIG. 6 and FIG. 7, the holder 60 is substantially block-shaped and has a first surface 61 and a second surface 62 opposite to each other, where the first surface 61 is opposite to the atomization surface 412 and keeps certain spacing from the same to form the atomization cavity 70. In design, this first surface 61 is inclined, particularly inclined upwards along the direction close to the first side wall 110. On one hand, the function of the first surface is to guide the airflow by means of the inclined design, as shown by an arrow R2 in FIG. 6, the airflow aslant flows out under the guidance of the first surface 61; and on the other hand, the condensate formed by condensation of the aerosol within the atomization cavity 70 after the aerosol encounters cold air and the liquid substrate seeped downwards from the atomization assembly 40 can be received by the first surface 61, gradually flow along the direction of an arrow R3 in FIG. 6 under the guidance of the inclined first surface 61, and fall off from the drainage side wall 64 of the holder 60.

Furthermore, the holder 60 is further provided with a through hole 63 passing through the atomizer 100 along the length direction, and the power supply electrode post 26 passes through the through hole 63 and then abuts against two ends of the heating element 42 on the atomization surface 412 to conduct electricity.

In a preferred embodiment shown in FIG. 7, the condensate flowing down from the holder 60 will gradually flow into a gap between the second surface 62 and the end cover 20, and the port height of the air inlet 24 within the end cover 20 is between the uppermost and lowermost of the inclined first surface 61. Therefore, the air flowing out of the port of the air inlet 24 is directed towards a certain middle portion of the first surface 61, such that the first surface 61 is able to at least partially guide the airflow passing through the atomization cavity 70.

Figure 8:
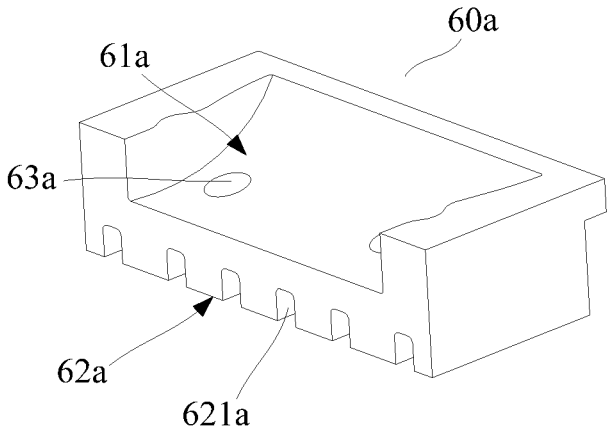
FIG. 8 is a schematic structural diagram of a holder according to another embodiment.

Furthermore, in order to prevent the condensate dripping from the holder 60 to the end cover 20 from being seeped out of the first mounting hole 22 and the second mounting hole 23 of the end cover 20, FIG. 8 shows a schematic diagram of a holder 60*a* having the inclined first surface 61*a* and the through hole 63*a* with the same function(s) as above according to another preferred embodiment. Additionally, several grooves 621*a* are provided on the second surface 62*a* opposite to the end cover 20, and the condensate can be adsorbed and retained by the grooves 621*a* using a capillary principle, further avoiding seepage of the condensate or the received liquid substrate. It can also be seen from FIG. 8 that the grooves 621*a* extend along the thickness direction of the atomizer 100, that is, parallel to the direction in which the airflow passes through the atomization cavity 70, such that a fluid force in the airflow promotes adsorption. In other variable embodiments, the grooves 621*a* may also be arranged in a bent, crossed, or the like manner. Alternatively, in other variable embodiments, the grooves 621*a* may be replaced with other capillary structures capable of adsorbing the condensate or liquid substrate by capillary action, such as structures having capillary pores or bumps.

Alternatively, in another preferred embodiment, referring to FIG. 9, a holder 60*b* having the through hole 63*b* with the same function(s) as above is formed by combining two components, specifically including:

a housing 610*b* and a liquid absorption component 620*b*, the housing 610*b* having a first surface 61*b* and a second surface 62*b* opposite to each other, where the first surface 61*b* is an inclined cambered surface and is configured to guide the airflow and receive the condensate; the housing 610*b* is internally provided with an open cavity located on the second surface 62*b*, and the liquid absorption component 620*b* configured to adsorb and retain the condensate is provided within the cavity; the liquid absorption component 620*b* is made of sponge, porous ceramic or foam materials or materials capable of absorbing liquid by capillary action, such that when the received condensate flows from the drainage side wall 64*b* to a gap with the end cover 20, the condensate can be absorbed by the surface, exposed out of the opening of the housing 610*b*, of the liquid absorption component 620*b*, thereby eliminating seepage of the condensate or liquid substrate.

In some embodiments, at least a part of the surface of the liquid absorption component 620*b* is exposed out of the housing 610*b* and forms the second surface 62*b*.

In some embodiments, at least a part of the first surface 61, 61*a*, 61*b* faces the first communication port 71 along the extension direction of the atomization surface.

Furthermore, in a preferred embodiment, a projection of the first surface 61 of the holder 60 on a plane perpendicular to the axial plane of the outer housing at least partially covers the atomization surface. Preferably, the projection along the axial direction of the atomizer 100 is greater than the atomization surface 412, and completely covers the atomization surface 412. Meanwhile, it can be seen from FIG. 5 and FIG. 7 that the structural portion, forming the air inlet 24, of the end cover 20 is not in contact with the drainage side wall 64 of the holder 60 along the thickness direction of the atomizer 100 and kept certain spacing, about 5 mm, from the same, such that the condensate can be smoothly guided, through the drainage side wall 64 of the holder 60, from the first surface 61 to the second surface 62 for absorption.

According to the above atomizer of the electronic cigarette, the atomization cavity is formed between the atomization surface and the holder, and the airflow passes through the whole atomization cavity in the smoking process, such that the aerosol within the atomization cavity can be guided out along with the airflow to the maximum extent to reduce retention; furthermore, the holder can receive and guide the condensate to the second surface, such that the condensate can be effectively prevented from being smoked along with the airflow or seeped.

It should be noted that the preferred embodiments of the present application are given in the description and the accompanying drawings of the present application, but are not limited to the embodiments described in the description, and furthermore, for those of ordinary skill in the art, improvements or transformations can be made according to the above description, and all these improvements and transformations should fall within the protection scope of the appended claims of the present application.

What is claimed is:

1. An atomizer, comprising:

an outer housing, the outer housing being internally provided with a liquid storage cavity for storing a liquid substrate;

and the outer housing comprising a first side wall and a second side wall opposite to each other so that the liquid storage cavity is disposed between the first side wall and the second side wall;

and an axial direction of the outer housing being defined to extend through the liquid storage cavity;

an atomization assembly disposed within the outer housing next to the liquid storage cavity along the axial direction of the outer housing for atomizing the liquid substrate from the liquid storage cavity to generate an aerosol so that the atomization assembly is disposed between the first and second side walls;

and an atomization surface of the atomization assembly for generating the aerosol extending from the first side wall to the second side wall at a side of the atomization assembly facing away from the liquid storage cavity;

and a holder disposed within the outer housing at the side of the atomization assembly and disposed to be spaced from the atomization surface;

the holder comprising a first surface facing the atomization surface along the axial direction of the outer housing;

an atomization cavity formed between the first surface and the atomization surface so that the first surface and the atomization surface are respectively located at two opposite sides of the atomization cavity along the axial direction of the outer housing;

wherein the outer housing comprises a first communication port formed between the first surface and the first side wall and configured to allow air entry into the atomization cavity;

and a second communication port formed between the atomization surface and the second side wall and configured to allow the generated aerosol by the atomization surface leaving away from the atomization cavity;

the first and second communication ports are distant from each other along both the axial direction and a direction perpendicular to the axial direction;

wherein the first surface is configured to be inclined by being increasingly spaced away from the atomization surface along an extension direction of the atomization surface between the first and second side walls, an airflow entering the atomization cavity from the first communication port at least partially flows to the second communication port along the extension direction of the atomization surface under guidance of the first surface;

and the first surface is configured to receive the liquid substrate seeped from the atomization assembly and/or condensate formed by condensation of the aerosol within the atomization cavity;

wherein an air inlet for allowing external air to enter and an airflow channel for outputting the aerosol are further provided within the outer housing;

and the first communication port faces a part of the first surface which is the farthest part of the first surface away from the atomization surface;

and the second communication port in communication with the atomization cavity faces another part of the first surface which is the closest part of the first surface to the atomization surface, such that an airflow entering the atomization cavity from the air inlet at least partially flows to the airflow channel along the extension direction of the atomization surface under the guidance of the first surface;

and the atomization cavity is in airflow communication with the air inlet through the first communication port, and is in airflow communication with the airflow channel through the second communication port.

2. The atomizer according to claim 1, wherein the holder further comprises a second surface facing away from the first surface along the axial direction of the outer housing, the second surface being configured to absorb or retain the liquid substrate and/or condensate received by the first surface.

3. The atomizer according to claim 2, wherein the holder further comprises a drainage side wall, and is configured to guide the liquid substrate and/or condensate received by the first surface to the second surface through the drainage side wall.

4. The atomizer according to claim 2, wherein the second surface is provided with grooves that absorb or retain the liquid substrate and/or condensate by capillary action.

5. The atomizer according to claim 2, wherein the holder comprises a housing, and a liquid absorption component accommodated in the housing and capable of absorbing the liquid substrate and/or condensate by the capillary action; wherein, the first surface is formed on the housing; and at least a part of the liquid absorption component is exposed out of the housing and forms the second surface.

6. The atomizer according to claim 1, wherein a projection of at least a part of the first surface on a plane perpendicular to the axial direction of the outer housing covers the atomization surface.

7. The atomizer according to claim 1, wherein the outer housing is configured as a hollow cylinder having an open end;

an end cover is provided at the open end, and the air inlet is formed in the end cover; and a sealing mechanism for sealing the liquid storage cavity and accommodating and retaining the atomization assembly is further provided within the outer housing; and at least a part of the airflow channel is provided on the sealing mechanism.

8. An electronic cigarette, comprising a power supply apparatus and the atomizer claim 1, the power supply apparatus being configured to supply power to the atomizer, and the atomizer being configured to atomize a liquid substrate to generate an aerosol for smoking.

9. The atomizer according to claim 1, wherein the holder further comprises a second surface facing away from the first surface along the axial direction of the outer housing, the second surface being configured to absorb or retain the liquid substrate and/or condensate received by the first surface.

10. The atomizer according to claim 9, wherein the holder further comprises a drainage side wall, and is configured to guide the liquid substrate and/or condensate received by the first surface to the second surface through the drainage side wall.

11. The atomizer according to claim 9, wherein the second surface is provided with grooves that absorb or retain the liquid substrate and/or condensate by capillary action.

12. The atomizer according to claim 11, wherein the holder comprises a housing, and a liquid absorption component accommodated in the housing and capable of absorbing the liquid substrate and/or condensate by the capillary action; wherein, the first surface is formed on the housing; and at least a part of the liquid absorption component is exposed out of the housing and forms the second surface.

13. The atomizer according to claim 1, wherein a projection of at least a part of the first surface on a plane perpendicular to the axial direction of the outer housing covers the atomization surface.

* * * * *